US006477746B1

(12) United States Patent
Axelsson

(10) Patent No.: US 6,477,746 B1
(45) Date of Patent: Nov. 12, 2002

(54) RELEASABLE BALL-LOCK CABLE TIE

(75) Inventor: Lennart Axelsson, Tinley Park, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 09/883,698

(22) Filed: Jun. 18, 2001

(51) Int. Cl.[7] ..... B65D 63/02
(52) U.S. Cl. ..... 24/25
(58) Field of Search ..... 24/25, 21, 23 R, 24/456, 136 A, 268, 115 L

(56) References Cited

U.S. PATENT DOCUMENTS

| | | | | |
|---|---|---|---|---|
| 25,125 | A | | 8/1859 | Knowles |
| 205,720 | A | | 7/1878 | Blossom |
| 206,076 | A | * | 7/1878 | Blossom |
| 225,517 | A | | 3/1880 | Gilman |
| 4,366,602 | A | | 1/1983 | Conlon et al. |
| 4,399,592 | A | | 8/1983 | Chopp, Jr. et al. |
| 4,935,993 | A | * | 6/1990 | Bree |
| 5,103,534 | A | | 4/1992 | Caveney |
| 5,291,637 | A | | 3/1994 | Meyers |
| 5,732,446 | A | | 3/1998 | Blanks |
| 5,850,674 | A | | 12/1998 | Jansen |
| 6,076,235 | A | | 6/2000 | Khokhar |
| 6,122,804 | A | * | 9/2000 | Gamaggio-Schafer |

* cited by examiner

*Primary Examiner*—James R. Brittain
(74) *Attorney, Agent, or Firm*—Robert A. McCann; Jay A. Saltzman; Christopher S. Clancy

(57) ABSTRACT

A cable tie for releasably bundling together a plurality of elongated objects. The cable tie includes an elongated band for circumscribing the plurality of elongated objects, and a locking head disposed thereon. The locking head includes a chamber and a chamber entry and exit, and an appropriately dimensioned ball disposed within the chamber such that the ball may assume one of at least two positions within the chamber, a first, generally free position when the band is being forwardly urged through the chamber and a second, generally restricted position when the band is being backwardly urged through the chamber, wherein when the band is being forwardly urged through the chamber the ball does not frictionally restrict the band in response to the forward urging, thereby permitting forward movement of the band through the chamber, and when the band is being backwardly urged through the chamber the ball frictionally restricts the band from substantial backward movement through the chamber in response to the backward urging. There is also an opening in the locking head for providing access to the ball by an implement such that the implement may be used to urge the ball from the second position toward the first position whereby the band may be urged backwardly and thereby moved backwardly through the chamber without the ball frictionally restricting the backward movement of the band as it would in the absence of the implement.

22 Claims, 5 Drawing Sheets

RELEASABLE BALL-LOCK CABLE TIE

BACKGROUND OF THE INVENTION

The present invention relates generally to cable ties, and more particularly to ball-type locking ties.

Ball-type locking heads are well-known for use in metal cable ties for providing high tensile strength bundling capability. In addition to typically having a higher tensile strength than plastic ties, metallic ties also tend to be less brittle and deformable when exposed to extreme temperatures, humidity, corrosive elements, and radiation. An example of a metal cable tie having a ball-type locking head is seen in U.S. Pat. No. 4,399,592.

As shown in the '592 patent, a typical metal cable tie may have a metallic band, one end of which is joined to a metallic locking head for receiving and retaining the other end of the band to bundle objects together. A metallic ball or roller means is captively held in the head for lockingly engaging the band. The ball is shiftable between a threading position wherein it is disposed relatively closer to the end of the head from where the threaded band emerges and a locking position wherein the ball is relatively closer to the end of the head into which the free end of the band is inserted. The tie will typically include band deflection structure for bending a portion of the band proximate the ball so as to permit the ball to rotate or slide over the band as the band is threaded forwardly through the locking head but also to force or wedge the ball into the locking position whereby it frictionally restricts unthreading of the band when backward force is applied to the band. In this manner, the band may be forwardly threaded to tightly bind together multiple objects and the ball-type locking head will prevent unthreading while maintaining high resistance to tensile failure.

Cable ties of the type disclosed in the '592 patent have come to have numerous useful applications. However, some applications calling for high tensile strength or other desirable qualities of the metal ball-type locking ties present a sporadic or regular need for unbinding the multiple objects. Typical metal ties have drawbacks in such situations because they must be cut, and thereby permanently destroyed, in order to remove them from their respective bundles. Thus, in order to re-bundle the objects, an entirely new cable tie would have to be applied, the former one not being reusable after being cut. Further complicating this process is the fact that cutting a metal band typically requires a tool that may not be on-hand or conveniently retrieved from the location of the tie.

Thus, there is a need for a cable tie having many or all of the performance qualities of prior metal ball-type locking cable ties while including the additional quality of being easily releasable and/or reusable.

SUMMARY OF THE INVENTION

To address this shortcoming in prior metal cable ties, a new cable tie is disclosed for releasably bundling together a plurality of elongated objects. The cable tie includes an elongated band for circumscribing the plurality of elongated objects, the band having first and second opposed ends. The cable tie further includes a locking head disposed generally on the first end of the elongated band. The locking head includes a chamber defined within the locking head, a chamber entry and exit for permitting the band to be moved forwardly through the chamber by inserting the second end of the band into the entry and urging the band in a forward direction through the chamber such that the second end of the band emerges from the exit and for permitting the band to be further moved beyond the chamber in the forward direction after the second end of the band has emerged from the exit by further forward urging of the band. The locking head further includes an appropriately dimensioned ball disposed within the chamber such that the ball may assume one of at least two positions within the chamber, the ball assuming a first, generally free position when the band is being forwardly urged through the chamber and a second, generally restricted position when the band is being backwardly urged through the chamber. When the band is being forwardly urged through the chamber the ball is disposed in the first, generally free position within the chamber and does not frictionally restrict the band in response to the forward urging, thereby permitting forward movement of the band through the chamber. When the band is being backwardly urged through the chamber the ball is disposed in the second, generally restricted position, thereby frictionally restricting the band from substantial backward movement through the chamber in response to the backward urging. There is also an opening in the locking head chamber for providing access to the ball by an implement such that the implement may be used to urge the ball from the second, generally restricted position toward the first, generally free position whereby the band may be urged backwardly and thereby moved backwardly through the chamber without the ball frictionally restricting the backward movement of the band as it would in the absence of the implement.

Also disclosed is a locking head for use with a cable tie for releasably bundling together a plurality of elongated objects. The cable tie includes an elongated band for circumscribing the plurality of elongated objects and having first and second opposed ends. The locking head includes a chamber defined within the locking head, a chamber entry and exit for permitting the band to be moved forwardly through the chamber by inserting the second end of the band into the entry and urging the band in a forward direction through the chamber such that the second end of the band emerges from the exit and for permitting the band to be further moved beyond the chamber in the forward direction after the second end of the band has emerged from the exit by further forward urging of the band. An appropriately dimensioned ball is disposed within the chamber such that the ball may assume one of at least two positions within the chamber, the ball assuming a first, generally free position when the band is being forwardly urged through the chamber and a second, generally restricted position when the band is being backwardly urged through the chamber. When the band is being forwardly urged through the chamber the ball is disposed in the first, generally free position within the chamber and does not frictionally restrict the band in response to the forward urging, thereby permitting forward movement of the band through the chamber. When the band is being backwardly urged through the chamber the ball is disposed in the second, generally restricted position, thereby frictionally restricting the band from substantial backward movement through the chamber in response to the backward urging. There is also an opening in the locking head chamber for providing access to the ball by an implement such that the implement may be used to urge the ball from the second, generally restricted position toward the first, generally free position whereby the band may be urged backwardly and thereby moved backwardly through the chamber without the ball frictionally restricting the backward movement of the band as it would in the absence of the implement.

Also disclosed is a system for releasably bundling together a plurality of elongated objects. The system includes a cable tie having an elongated band for circumscribing the plurality of elongated objects, the band having first and second opposed ends. The system also includes a locking head disposed generally on the first end of the elongated band, the locking head including a chamber defined within the locking head, a chamber entry and exit for permitting the band to be moved forwardly through the chamber by inserting the second end of the band into the entry and urging the band in a forward direction through the chamber such that the second end of the band emerges from the exit and for permitting the band to be further moved beyond the chamber in the forward direction after the second end of the band has emerged from the exit by further forward urging of the band. An appropriately dimensioned ball is disposed within the chamber such that the ball may assume one of at least two positions within the chamber, the ball assuming a first, generally free position when the band is being forwardly urged through the chamber and a second, generally restricted position when the band is being backwardly urged through the chamber. When the band is being forwardly urged through the chamber the ball is disposed in the first, generally free position within the chamber and does not frictionally restrict the band in response to the forward urging, thereby permitting forward movement of the band through the chamber. When the band is being backwardly urged through the chamber the ball is disposed in the second, generally restricted position, thereby frictionally restricting the band from substantial backward movement through the chamber in response to the backward urging. There is also an opening in the locking head for providing access to the ball. The system also includes an implement for being inserted generally into the opening and thereby urging the ball from the second, generally restricted position toward the first, generally free position whereby the band may be urged backwardly and thereby moved backwardly through the chamber without the ball frictionally restricting the backward movement of the band as it would in the absence of the implement.

DETAILED DESCRIPTION A PREFERRED EMBODIMENT OF THE INVENTION

Figure 1:
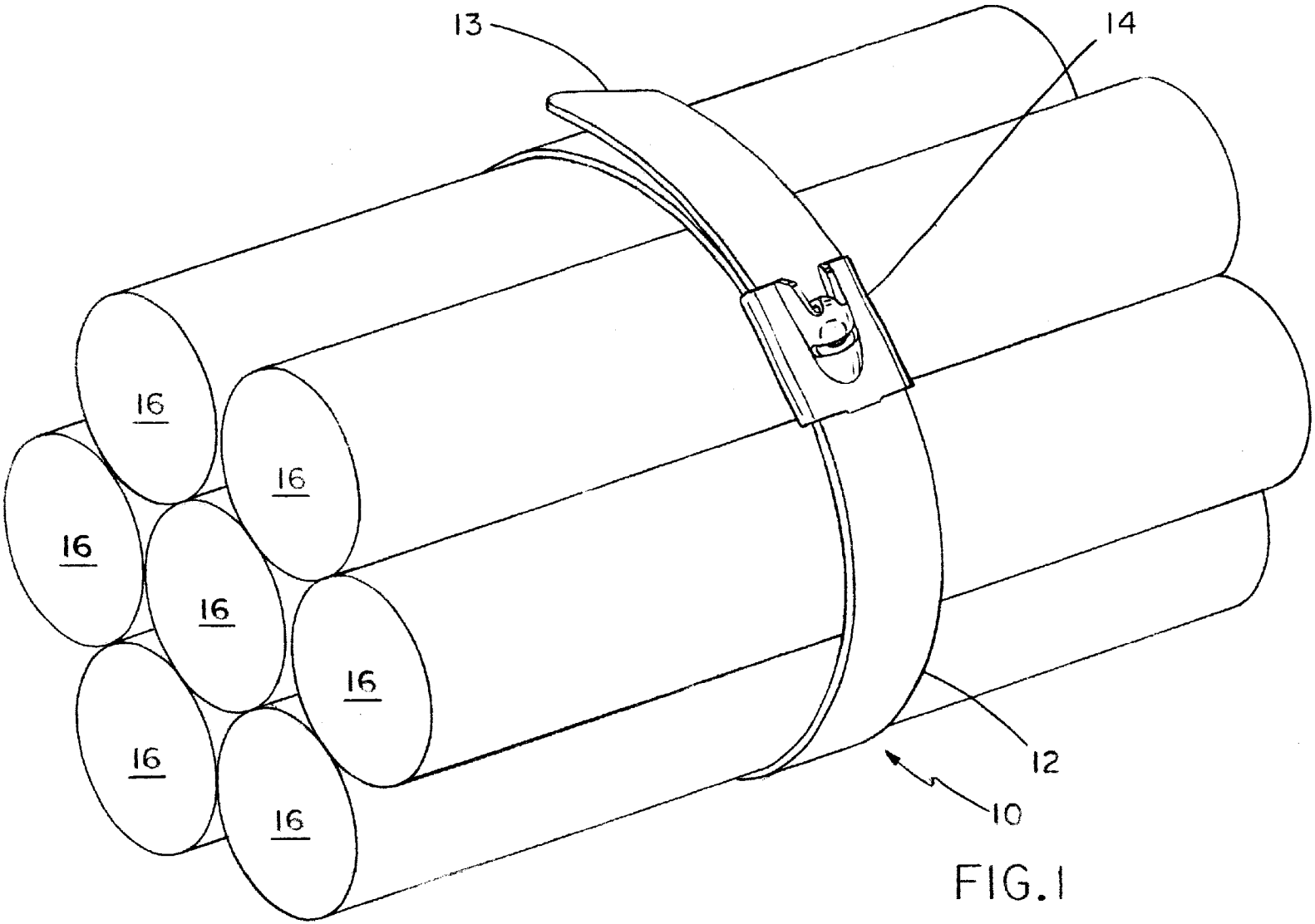
FIG. 1 is a perspective view of a cable tie in a typical context of application in accordance with an embodiment of the invention.

In a preferred embodiment of the invention, a cable tie 10, shown in typical context of application in FIG. 1, is used to bundle together a number of elongated objects 16. The tie 10 includes an elongated band 12 for circumscribing the objects 16 and a ball-type locking head 14 for retaining the band in a generally circumscribing disposition about the objects. An example of a typical metal cable tie having a ball-type locking head is seen in U.S. Pat. No. 4,399,592, the disclosure of which is incorporated herein by reference.

Figure 2:
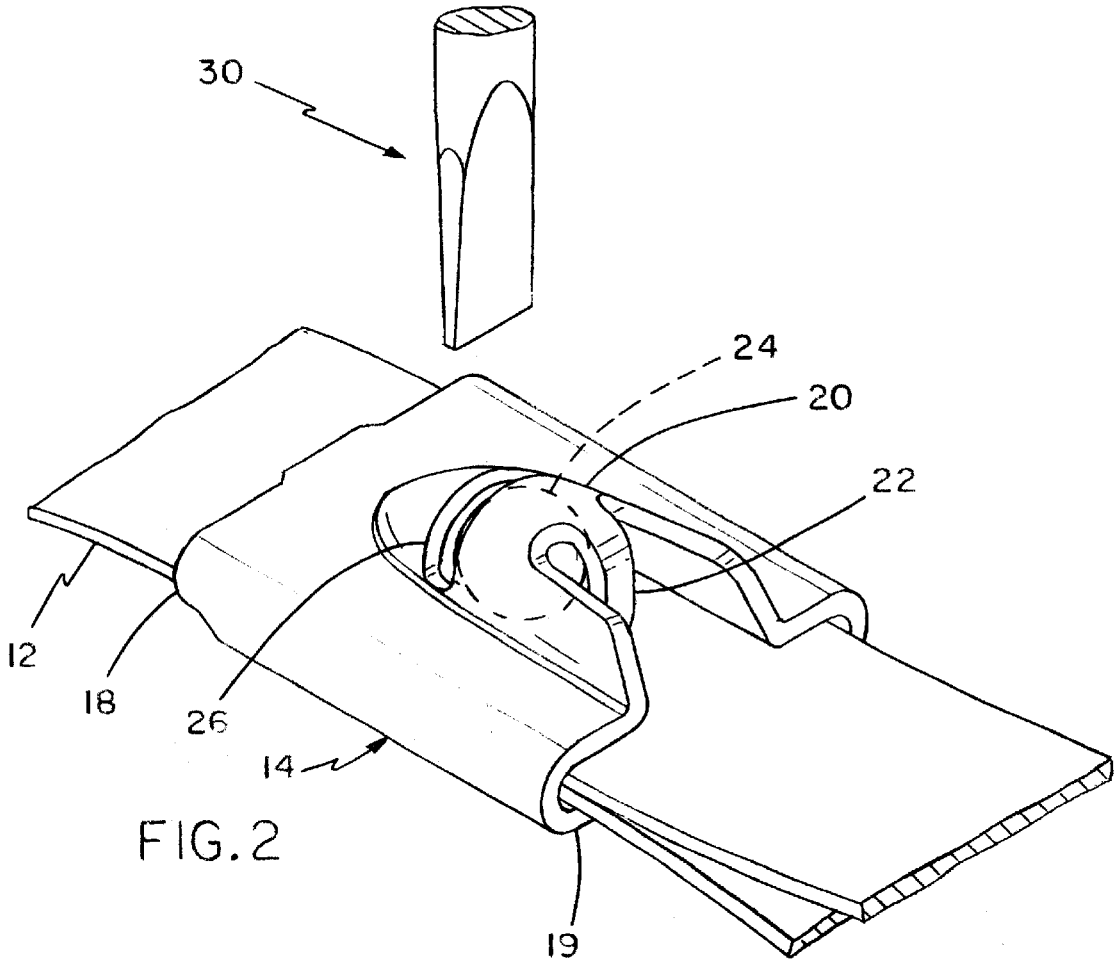
FIG. 2 is a perspective view of a locking head and implement in accordance with the embodiment of FIG. 1.
Figure 3:
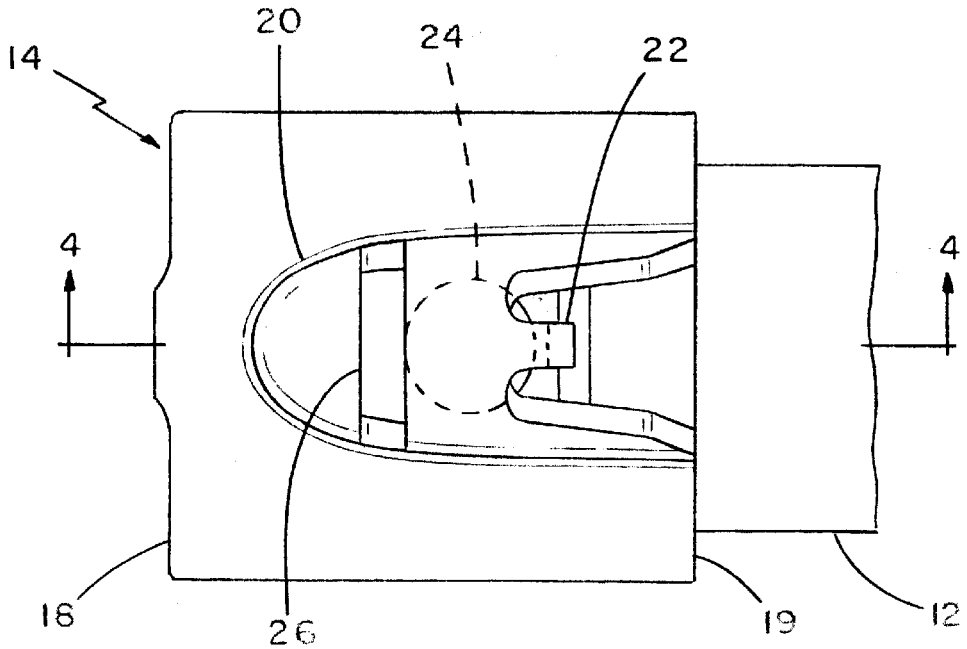
FIG. 3 is a top plan view of a locking head in accordance with the embodiment of FIG. 1.

A locking head 14 in accordance with the present invention is shown in greater detail in FIGS. 2 and 3. The head has an entry end 18 into which the free end 13 of the band 12 is inserted during the process of applying the cable tie to retain the bundle of objects. The free end 13 may be angled, as shown in FIG. 1, to facilitate threading the end 13 into the entry end 18 of the head 14. As the process of applying the tie continues, the band 12 is further inserted into the locking head until the free end 13 emerges from the exit end 19 of the locking head 14. The band 12 may be further inserted, with the free end 13 moving further and further past the locking head 14, until the slack in the band is exhausted and the band tightly circumscribes the bundle of objects.

The locking head 14 includes a chamber defined by a domed portion 20 thereof and a bent finger 22. The chamber is not completely enclosed and is spatially contiguous with the entry and exit of the locking head 14. Inside the chamber resides a ball 24. The ball may take on a variety of shapes and sizes and be made of different materials, depending on the configuration and material of the chamber, but in the presently described embodiment, the ball is generally round and metallic. During the application process, as the free end of the band 13 is fed through and then beyond the locking head 14, the band 12 travels through the locking head underneath the ball 24. The head further includes a slot 26 or other opening in the domed portion 20.

Figure 4:
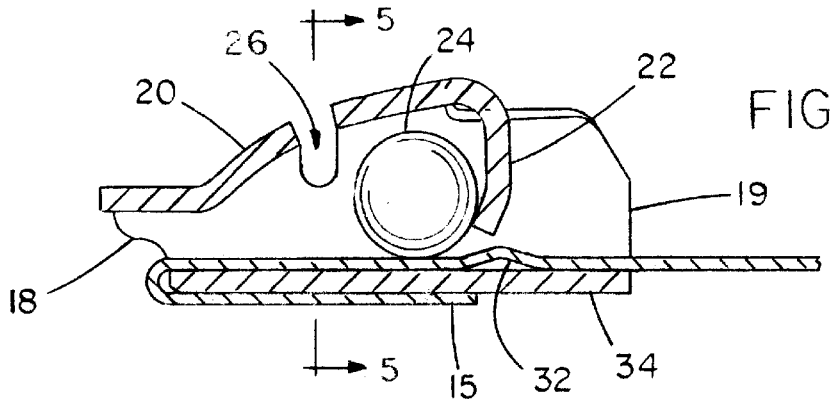
FIG. 4 is a cross-sectional side elevational view of a locking head in accordance with the embodiment of FIG. 1 taken across the line 4—4 in FIG. 3.
Figure 5:
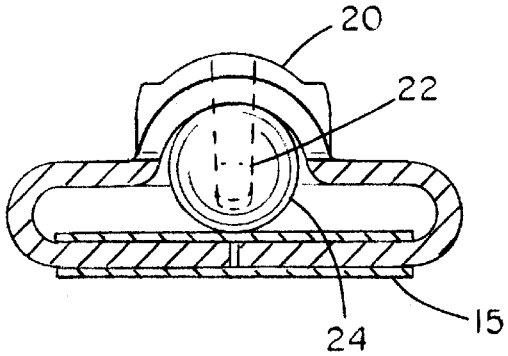
FIG. 5 is a cross-sectional front elevational view of a locking head in accordance with the embodiment of FIG. 1 taken across the line 5—5 in FIG. 4.

FIGS. 4–7 show how the ball is disposed in the chamber at various times during the application process of a cable tie in accordance with an embodiment of the invention. FIG. 4 shows where the ball might be positioned within the chamber when the locking head is oriented as shown relative to the horizontal and the free end 13 of the band 12 has not yet been inserted into the entry end 18 of the locking head 14. FIG. 5 shows a cross-sectional view in perpendicular direction relative to FIG. 4.

Figure 6:
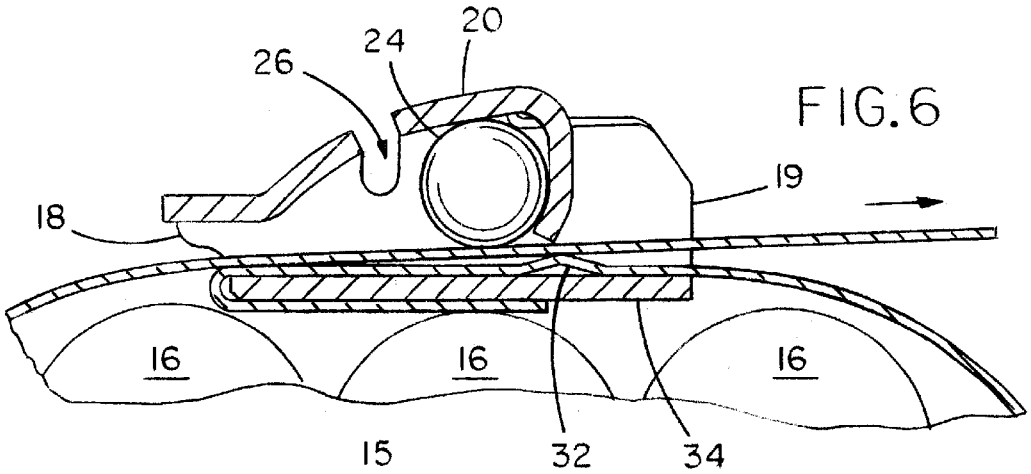
FIG. 6 is a cross-sectional side elevational view akin to that of FIG. 4 wherein the cable tie is being applied to bundle elongated elements and the band is being forwardly urged through the locking head.

The free end is inserted all the way through and beyond the locking head in FIG. 6 with, as indicated by the arrow, the band being pulled further through the head to constrict more tightly about the elongated objects. As can be seen in FIGS. 4–7, the non-free end 15 of the band is wrapped around and adhered to the bottom 34 of the locking head 14.

The band includes a deflection portion 32 along the inner surface of the locking head bottom 34 generally near the exit end 19. With particular reference to FIG. 6, as the band is forwardly pulled through the locking head, the deflection portion 32 causes the tensioned band to rise above the locking head bottom 34 and a space or clearance to be formed between overlying portions of the band. The ball 24 may be pressed upward into the domed portion 20 of the head, but the clearance permits the band to be moved forwardly through the head, the ball being able to roll or slide and/or deflect the band somewhat into the clearance. The clearance provided by the band deflection portion 32 helps prevent the ball from becoming lodged in the chamber and from frictionally preventing forward urging of the band through the locking head.

Figure 7:
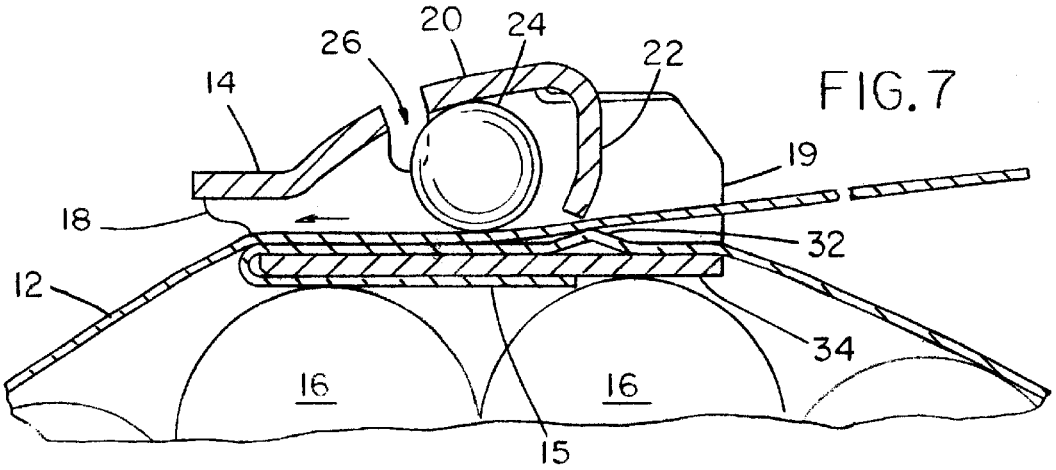
FIG. 7 is a cross-sectional side elevational view akin to that of FIG. 6 wherein the cable tie has been applied to bundle elongated elements and the band, after having been moved forwardly through the locking head, is being urged backwardly through the locking head.

FIG. 7 shows the cable tie applied tightly around a bundle of objects 16. The tension in the band 12 causes the band to be urged backwardly relative to the locking head, as indicated by the arrow in this figure. As the band slips backwardly a nominal distance, it frictionally carries the ball 24 with it toward the entry end 18 of the locking head 14. As the domed portion 20 is tapered, the ball 24 becomes lodged between the domed portion and the two layers of band abutting the bottom 34 of the head. Thus, the ball frictionally prevents the band from anything more than nominal backward travel through the locking head.

Figure 8:
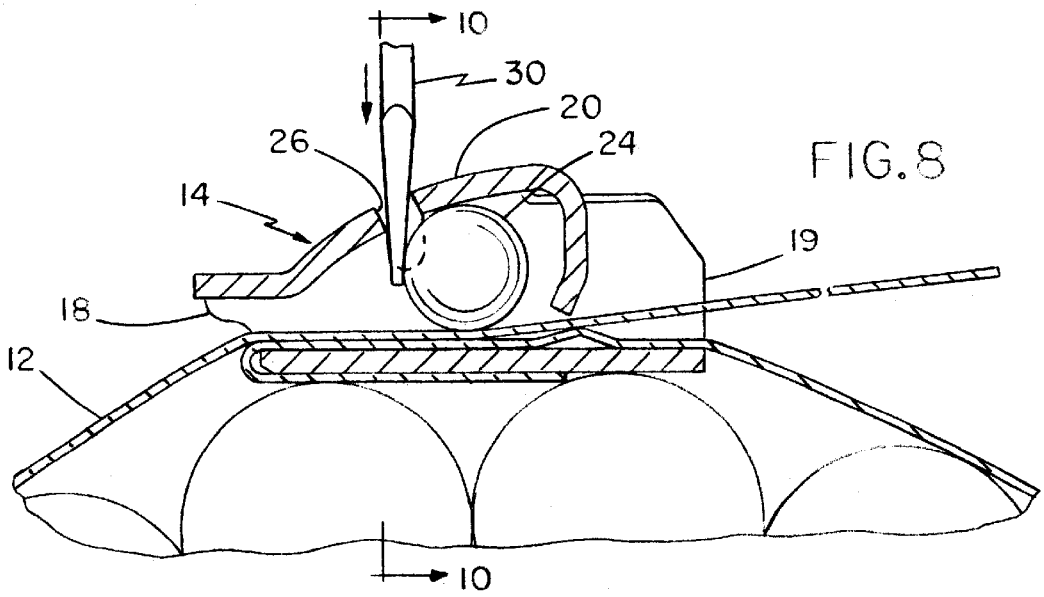
FIG. 8 is a cross-sectional side elevational view akin to that of FIG. 7 wherein an implement has been inserted through the opening in the locking head.
Figure 9:
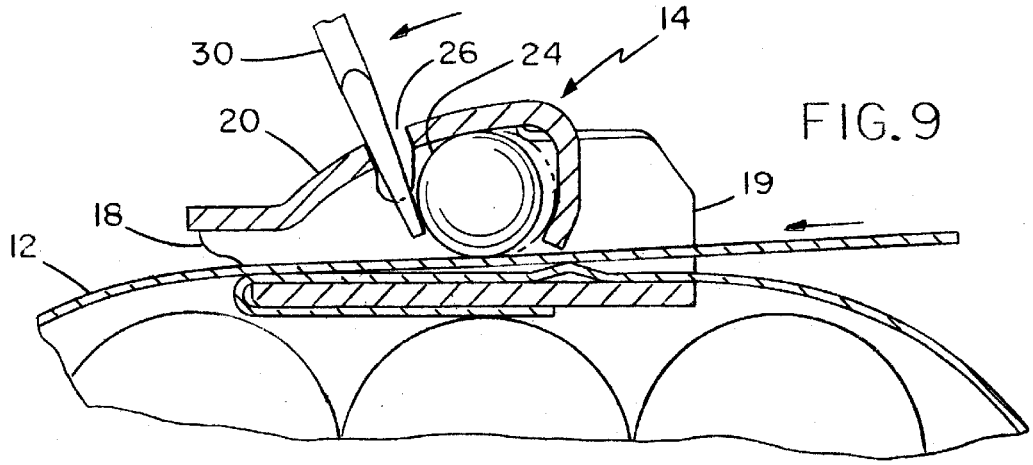
FIG. 9 is a cross-sectional side elevational view akin to that of FIG. 8 wherein the implement has been rotated to move the ball within the locking head.

Preferably, the ball 24 becomes lodged in a position from where it is relatively accessible through the slot 26. In particular, as shown in FIGS. 8–12, an implement 30, such as a slotted screwdriver for example, may be inserted through the slot to contact and dislodge the ball 24 by pushing it back toward the exit end 19 of the head 14. FIG. 8 shows how the implement 30 may be inserted through the slot 26 to contact the ball 24 while FIG. 9 shows how the implement 30 may be rotated to dislodge the ball 24 and urge it toward the exit end 19 of the head 14.

Figure 10:
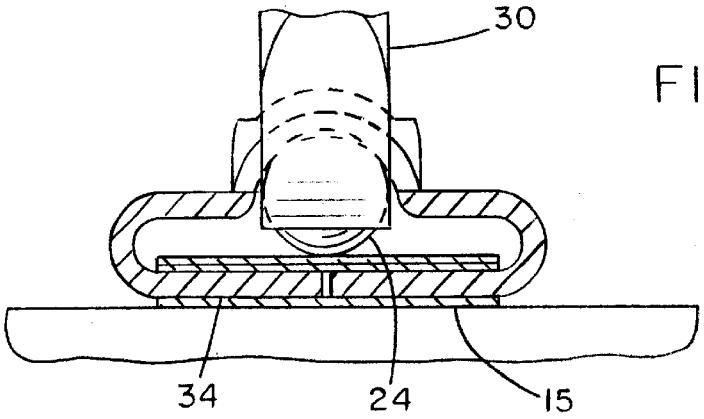
FIG. 10 is a cross-sectional front elevational view of a locking head in accordance with the embodiment of FIG. 1 taken along the line 10—10 in FIG. 8.

While the implement is keeping the ball from its position where it may become lodged, the band 12 may be moved backwardly through the locking head to more than a nominal extent such that the cable tie may be loosened. The free end of the band may eventually be backwardly passed through the head, thereby releasing the cable tie altogether. FIG. 10 shows a cross-sectional view in perpendicular direction relative to FIGS. 8 and 9. In the manner shown and described, the cable tie is releasable from the bundle of elongated objects. Also, because the cable tie is releasable without severing the band in any manner or causing any damage to the locking head, the cable tie is entirely reusable.

Figure 11:
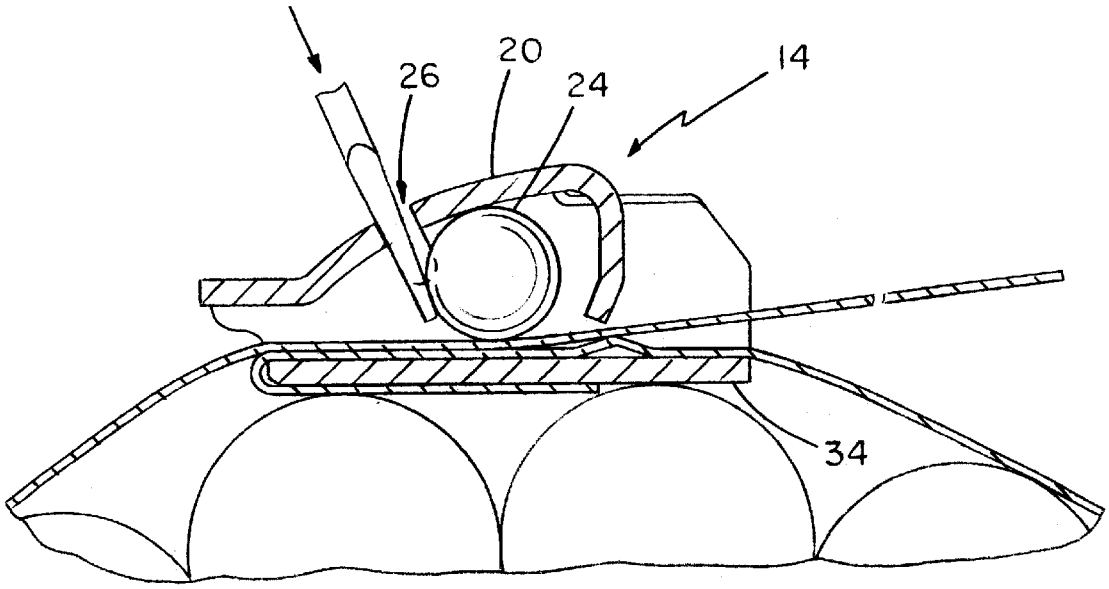
FIG. 11 is a cross-sectional side elevational view of a locking head in accordance with an alternate embodiment of the invention wherein an implement has been inserted through the opening in the locking head.
Figure 12:
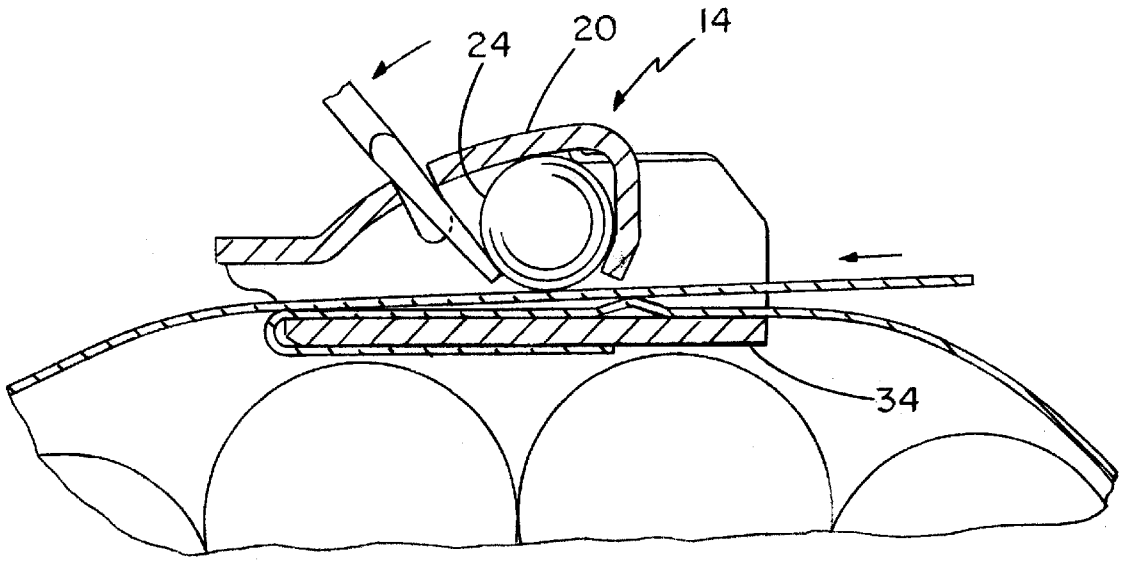
FIG. 12 is a cross-sectional side elevational view akin to that of FIG. 11 wherein the implement has been rotated to move the ball within the locking head.

FIGS. 11 and 12 show an alternative embodiment of the invention wherein the slot 26 is cut more in accordance with the contour of the domed portion 20 of the locking head rather than being generally perpendicular to the bottom 34 of the head 14. The change in profile of the slot may, depending on the configuration of the head 14 and ball 24, facilitate easier access to the ball by the implement 30 to dislodge and move the ball so that the cable tie can be released. Specifically, FIG. 11 shows the insertion of the implement 30 in this embodiment, while FIG. 12 shows how the implement may be rotated to dislodge the ball 24 and permit backward travel of the band through the head. The slot of the embodiment shown in FIGS. 1–10 10 has a curved centerline oriented generally in a plane perpendicular with the bottom 34 of the locking head 14, while the embodiment of FIGS. 11 and 12 has a slot cut generally normally to the contoured domed portion 20 at each point on the contoured surface.

The invention provides an improved cable tie, locking head and system for providing a releasable ball-type locking tie. It should be noted that the above-described and illustrated embodiments of the invention are not an exhaustive listing of the forms the invention could take; rather, they serve as exemplary and illustrative of preferred embodiments of the invention as presently understood. Many other forms of the invention are believed to exist. The invention is defined by the following claims.

What is claimed is:

1. A cable tie for releasably bundling together a plurality of elongated objects, said cable tie comprising:

an elongated band for circumscribing said plurality of elongated objects, said band having first and second opposed ends; and a domed locking head disposed generally on said first end of said elongated band, said locking head including:

a chamber defined within said locking head;

a chamber entry and exit for permitting said band to be moved forwardly through said chamber by inserting said second end of said band into said entry and urging said band in a forward direction through said chamber such that said second end of said band emerges from said exit and for permitting said band to be further moved beyond said chamber in said forward direction after said second end of said band has emerged from said exit by further forward urging of said band;

an appropriately dimensioned ball disposed within said chamber such that said ball may assume one of at least two positions within said chamber, said ball assuming a first, generally free position when said band is being forwardly urged through said chamber and a second, generally restricted position when said band is being backwardly urged through said chamber, wherein when said band is being forwardly urged through said chamber said ball is disposed in said first, generally free position within said chamber and does not frictionally restrict said band in response to said forward urging, thereby permitting forward movement of said band through said chamber, and when said band is being backwardly urged through said chamber said ball is disposed in said second, generally restricted position, thereby frictionally restricting said band from substantial backward movement through said chamber in response to said backward urging; and a slotted opening in said locking head between said chamber entry and said chamber exit for providing access to said ball by an implement such that said implement may be used to urge said ball from said second, generally restricted position toward said first, generally free position whereby said band may be urged backwardly and thereby moved backwardly through said chamber without said ball frictionally restricting said backward movement of said band as it would in the absence of said implement.

2. A cable tie in accordance with claim 1 wherein said cable tie is reusable after being released from bundling said plurality of elongated objects.

3. A cable tie in accordance with claim 1 wherein said elongated band includes a deflection portion.

4. A cable tie in accordance with claim 1 wherein said ball is generally round.

5. A cable tie in accordance with claim 1 wherein said locking head, said band, and said ball are all primarily metallic.

6. A domed locking head for use with a cable tie for releasably bundling together a plurality of elongated objects, said cable tie including an elongated band for circumscribing said plurality of elongated objects and having first and second opposed ends, said locking head comprising:

a chamber defined within said locking head;

a chamber entry and exit for permitting said band to be moved forwardly through said chamber by inserting said second end of said band into said entry and urging said band in a forward direction through said chamber such that said second end of said band emerges from said exit and for permitting said band to be further moved beyond said chamber in said forward direction after said second end of said band has emerged from said exit by further forward urging of said band;

an appropriately dimensioned ball disposed within said chamber such that said ball may assume one of at least two positions within said chamber, said ball assuming a first, generally free position when said band is being forwardly urged through said chamber and a second, generally restricted position when said band is being backwardly urged through said chamber, wherein when said band is being forwardly urged through said chamber said ball is disposed in said first, generally free position within said chamber and does not frictionally restrict said band in response to said forward urging, thereby permitting forward movement of said band through said chamber, and when said band is being backwardly urged through said chamber said ball is disposed in said second, generally restricted position, thereby frictionally restricting said band from substantial backward movement through said chamber in response to said backward urging; and a slotted opening in said locking head, said opening being disposed generally between said chamber entry and said chamber exit, and for providing access to said ball by an implement such that said implement may be used to urge said ball from said second, generally restricted position toward said first, generally free position whereby said band may be urged backwardly and thereby moved backwardly through said chamber without said ball frictionally restricting said backward movement of said band as it would in the absence of said implement.

7. A locking head in accordance with claim 6 wherein said ball is generally round.

8. A locking head in accordance with claim 6 wherein said locking head, said band, and said ball are all primarily metallic.

9. A system for releasably bundling together a plurality of elongated objects, said system comprising:

a cable tie including:

an elongated band for circumscribing said plurality of elongated objects, said band having first and second opposed ends;

a domed locking head disposed generally on said first end of said elongated band, said locking head including:

a chamber defined within said locking head;

a chamber entry and exit for permitting said band to be moved forwardly through said chamber by inserting said second end of said band into said entry and urging said band in a forward direction through said chamber such that said second end of said band emerges from said exit and for permitting said band to be further moved beyond said chamber in said forward direction after said second end of said band has emerged from said exit by further forward urging of said band;

an appropriately dimensioned ball disposed within said chamber such that said ball may assume one of at least two positions within said chamber, said ball assuming a first, generally free position when said band is being forwardly urged through said chamber and a second, generally restricted position when said band is being backwardly urged through said chamber, wherein when said band is being forwardly urged through said chamber said ball is disposed in said first, generally free position within said chamber and does not frictionally restrict said band in response to said forward urging, thereby permitting forward movement of said band through said chamber, and when said band is being backwardly urged through said chamber said ball is disposed in said second, generally restricted position, thereby frictionally restricting said band from substantial backward movement through said chamber in response to said backward urging; and a slotted opening in said locking head for providing access to said ball, said opening being disposed generally between said chamber entry and said chamber exit; and an implement for being inserted generally into said opening and thereby urging said ball from said second, generally restricted position toward said first, generally free position whereby said band may be urged backwardly and thereby moved backwardly through said chamber without said ball frictionally restricting said backward movement of said band as it would in the absence of said implement.

10. A system in accordance with claim 9 wherein said cable tie is reusable after being released from bundling said plurality of elongated objects.

11. A system in accordance with claim 9 wherein said elongated band includes a deflection portion.

12. A system in accordance with claim 9 wherein said ball is generally round.

13. A system in accordance with claim 9 wherein said locking head, said band, and said ball are all primarily metallic.

14. A locking head in accordance with claim 1 wherein said slotted opening is generally disposed transversely to said elongated band.

15. A locking head accordance with claim 1 wherein said slotted opening is at least as long as the diameter of said ball.

16. A locking head in accordance with claim 1 wherein said slotted opening follows the contour of said domed locking head.

17. A system in accordance with claim 6 wherein said slotted opening is generally disposed transversely to said elongated band.

18. A system in accordance with claim 6 wherein said slotted opening is at least as long as the diameter of said ball.

19. A system in accordance with claim 6 Wherein said slotted opening follows the contour of said domed locking head.

20. A cable tie in accordance with claim 9 wherein said slotted opening is generally disposed transversely to said elongated band.

21. A cable tie in accordance with claim 9 wherein said slotted opening is at least as long as the diameter of said ball.

22. A cable tie in accordance with claim 9 wherein said slotted opening follows the contour of said domed locking head.

* * * * *